US006886780B1

(12) United States Patent
Frontera Castaner

(10) Patent No.: US 6,886,780 B1
(45) Date of Patent: May 3, 2005

(54) MODEL LANDING GEAR ASSEMBLY

(75) Inventor: Miguel A. Frontera Castaner, St. Joseph, IL (US)

(73) Assignee: Hobbico, Inc., Champaign, IL (US)

( * ) Notice: Subject to any disclaimer, the term of this patent is extended or adjusted under 35 U.S.C. 154(b) by 0 days.

(21) Appl. No.: 10/690,062

(22) Filed: Oct. 21, 2003

(51) Int. Cl.[7] ..... B64C 25/00
(52) U.S. Cl. ..... 244/104 LS; 244/104 R; 446/57
(58) Field of Search ..... 244/100 R, 104 R, 244/104 LS, 103 R, 102 R; 446/57

(56) References Cited

U.S. PATENT DOCUMENTS 5,078,638 A * 1/1992 Molina ..... 446/57
5,575,700 A * 11/1996 Cohen ..... 446/34
6,183,331 B1 * 2/2001 Lai ..... 446/34
6,715,714 B2 * 4/2004 Temple ..... 244/104 CS

* cited by examiner

*Primary Examiner*—Teri Pham Luu
*Assistant Examiner*—T. Nguyen
(74) *Attorney, Agent, or Firm*—Gardner Carton & Douglas, LLP

(57) ABSTRACT

A wheel assembly, in particular, a landing gear assembly for an aircraft model that includes a mounting block and a pair of landing gear struts that are capable of being attached to the mounting block without the use of any tools. The mounting block includes individual attachment points for each individual landing gear strut that makes up the pair of gear struts. A method for installing the landing gear struts is also disclosed.

17 Claims, 7 Drawing Sheets

MODEL LANDING GEAR ASSEMBLY

FIELD OF THE INVENTION

This invention pertains to assembly components for a model replica in general and, more particularly, to a landing gear assembly for a model aircraft.

BACKGROUND OF THE INVENTION

Model replicas of aircraft, ships and other vehicles are well known. The first of these models were carved out of wood. In addition to wood, other materials such as plastic and fiberglass have been used to manufacture models.

In building models, authenticity has always been important. For this reason, plastic was used since it could be shaped to form an exact replica of a particular vehicle or part. Over time, in addition to authenticity, model aficionados began to demand models with movable parts. This demand for movable parts created the need to develop workable assemblies of various model components such as doors, windows and wheel assemblies. In developing these components, it became necessary to use various tools such as needle-nose pliers or a screwdriver to assemble the miniature components. This need for tools increased the complexity of model building.

In addition to making models with movable parts, hobbyists have advanced to the stage where they want models to perform some of the same functions as their full-scale counterparts. This has led to the development of radio-controlled models of aircraft that fly, boats that sail and automobiles that drive. While functioning models have increased the popularity of the hobby, they have some drawbacks in that certain parts and assemblies must perform relatively heavy-duty functions in order to operate the model. This has resulted in the need to make these parts and assemblies easy to install and replace, preferably without the need for any tools.

One such assembly that is required to perform a rather heavy-duty function is a landing gear assembly for a model aircraft. Because of the shock imparted to the assembly, not only on take-off and landing, but also through taxiing on a prepared or unprepared surface, a landing gear assembly must be securely attached to the model. The ability to attach such an assembly to a model without the use of tools, messy glues or connectors, such as screws or washers that may loosen and fall off or mar the finish of the model, would be an important improvement in the art.

BRIEF SUMMARY OF THE INVENTION

The invention relates to a model aircraft having a landing gear assembly that is comprised of a mounting block and a pair of landing gear struts attached to the mounting block. The invention also relates to a model replica of a vehicle having a wheel assembly that is comprised of a mounting block and a pair of axles attached to the mounting block.

In an embodiment, the invention provides a landing gear assembly comprised of a mounting block and a pair of landing gear struts that are capable of being attached to the mounting block without the use of any tools. The mounting block includes individual attachment points for each individual landing gear strut that makes up the pair of landing gear struts. In another embodiment, the invention provides a wheel assembly for a model replica of a vehicle.

The invention also provides a method for installing a landing gear on a model aircraft. In an embodiment, the model aircraft has a fuselage that has an opening on each of its sides. A mounting block having a first side and a second side, with a plurality of attachment points protruding from the second side, is positioned within the fuselage in alignment with the openings. A portion of a landing gear strut that includes a hole is slid through one of the openings in the fuselage until one of the attachment points is engaged in the hole.

DETAILED DESCRIPTION OF THE INVENTION

Figure 1:
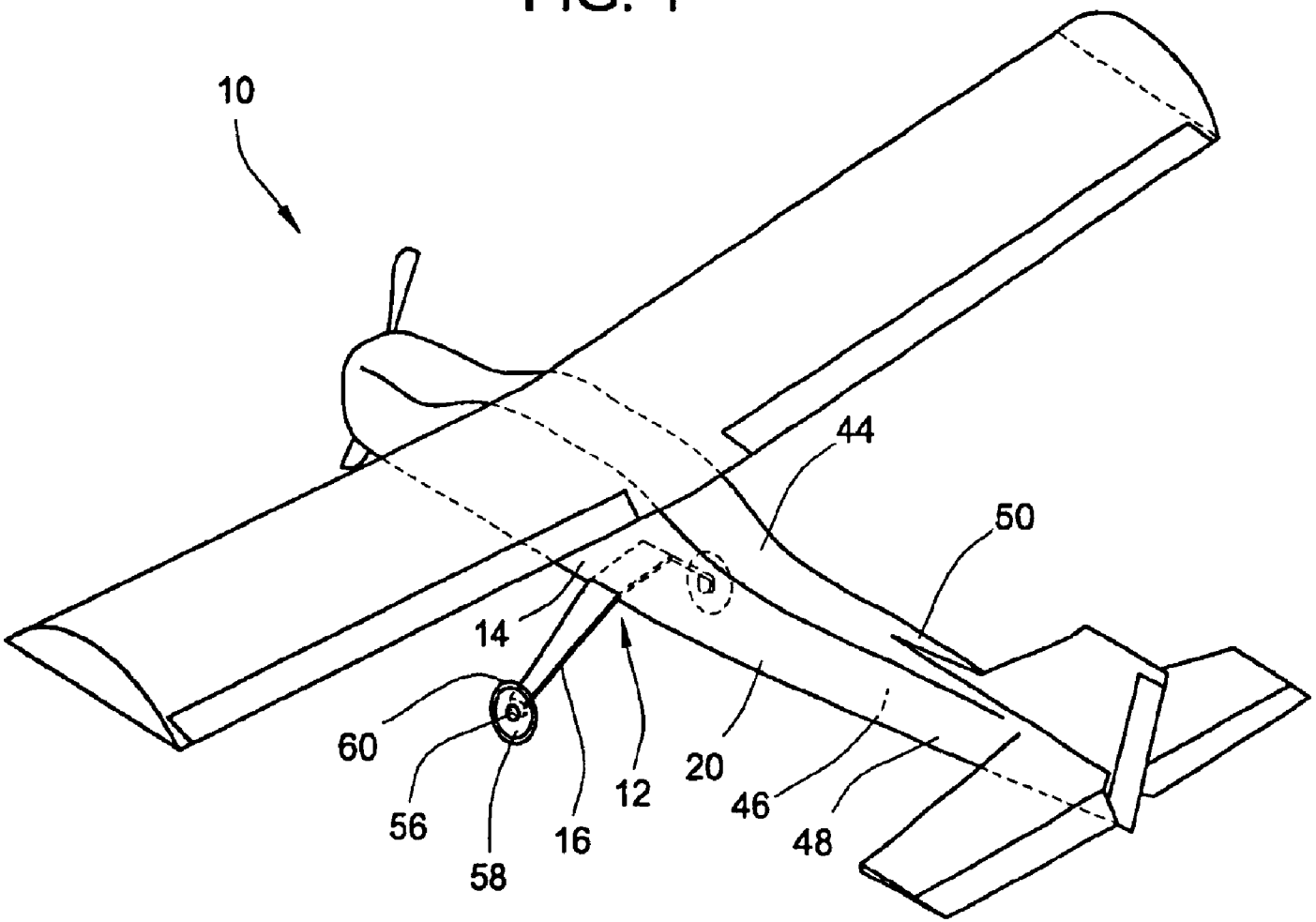
FIG. 1 is a perspective view of a model aircraft with the landing gear assembly installed.

As shown in FIGS. 1–5, the invention relates to a model aircraft 10, such as a radio-controlled model, having a landing gear assembly 12. In an embodiment, the landing gear assembly 12 includes a mounting block 14 and a pair of landing gear struts 16 that are attached to the mounting block 14. The mounting block 14 includes an individual attachment point 18 for each landing gear strut 16.

Figure 2:
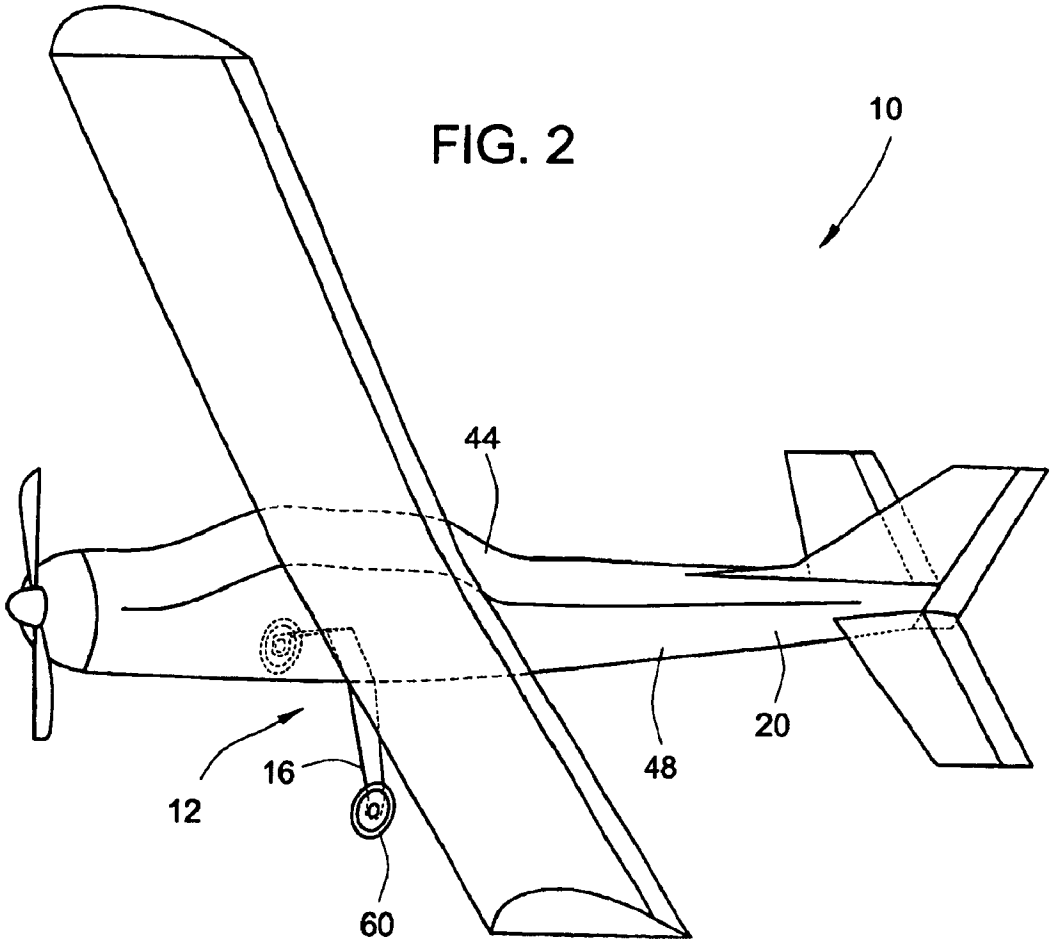
FIG. 2 is a second perspective view of a model aircraft showing the landing gear assembly.
Figure 3B:
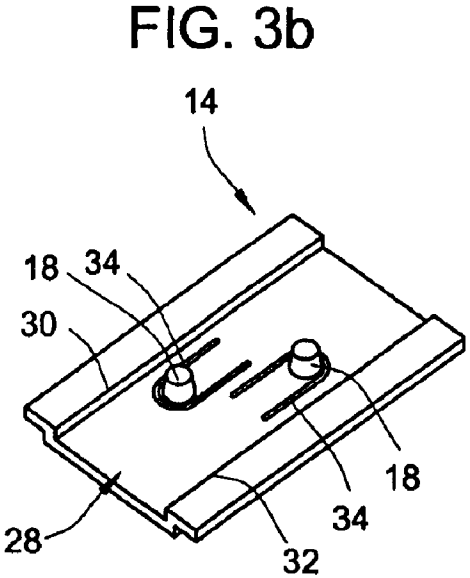
FIG. 3*b* is a perspective view showing the mounting block.
Figure 3D:
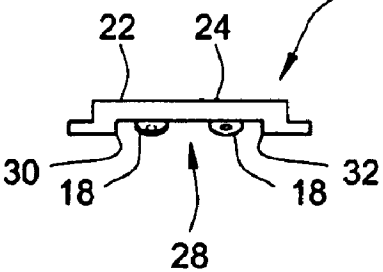
FIG. 3*d* is an end view of the mounting block.
Figure 3A:
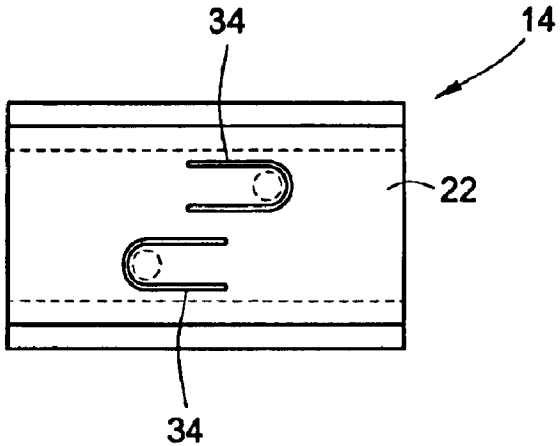
FIG. 3*a* is a top view of the mounting block used with the landing gear assembly.
Figure 3C:
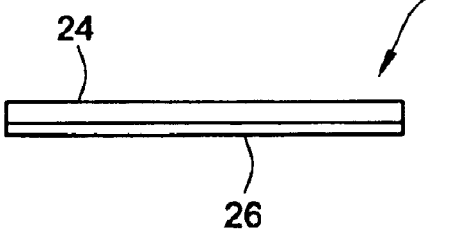
FIG. 3*c* is a front view of the mounting block.
Figure 4B:
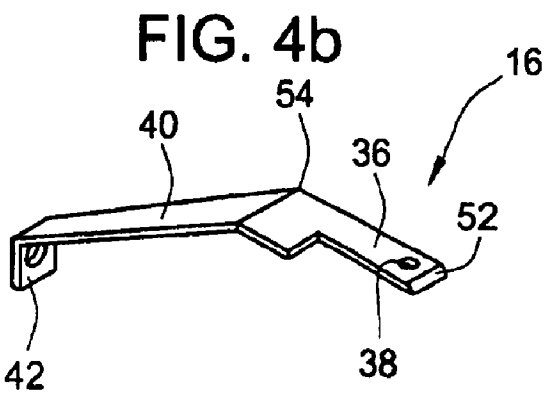
FIG. 4*b* is a perspective view of a landing gear strut.
Figure 4D:
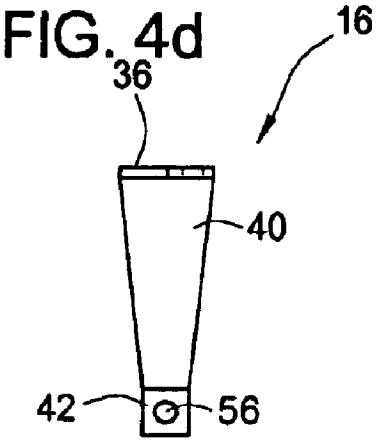
FIG. 4*d* is an end view of a landing gear strut.
Figure 4A:
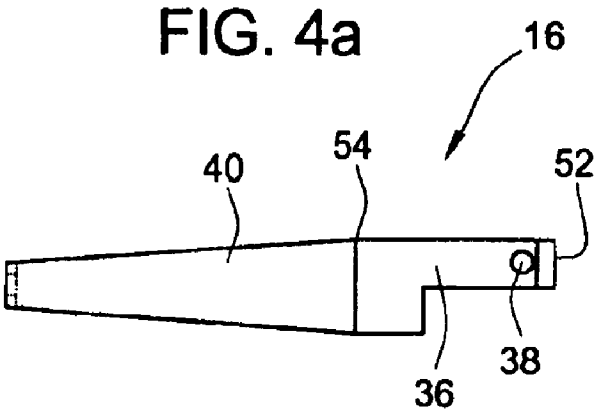
FIG. 4*a* is a top view of a landing gear strut used with the landing gear assembly.
Figure 4C:
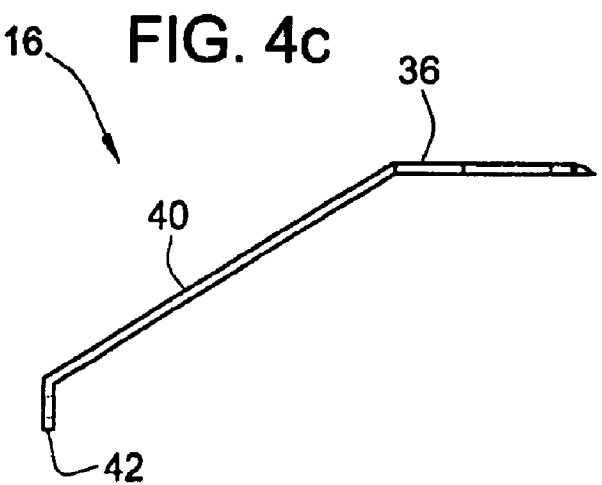
FIG. 4*c* is a front view of a landing gear strut.

In an embodiment, the landing gear assembly 12 may be attached to the fuselage 20 of the model aircraft 10, as shown in FIGS. 1 and 2.

In order to allow for attachment of the landing gear struts 16, the mounting block 14 has a planar surface 22 having a first side 24 and a second side 26, as shown in FIGS. 3(*c*) and 3(*d*). The second side 26 of the planar surface 22 defines a channel 28 with respect to a first and a second edge 30, 32 of the mounting block 14. The planar surface 22 also includes a pair of slits 34 with at least one of the pair of slits 34 surrounding a portion of an individual attachment point 18, as shown in FIGS. 3(*a*) and 3(*b*). These slits 34 allow the attachment point 18 to "give" when the landing gear strut 16 is passed over the mounting block 14, thereby allowing the strut 16 to engage the mounting block 14.

To facilitate the attachment of the landing gear strut 16 to the mounting block 14, a landing gear strut 16, as shown in FIGS. 4(*a*)–4(*d*), includes a first portion 36 that is oriented substantially parallel to the planar surface 22 of the mounting block 14. The first portion 36 includes a hole 38 and an inclined front edge 52. A second portion 40 of the gear strut 16 is adjacent to and angled less than 90° with respect to the first portion 36, and a third portion 42 is adjacent to the second portion 40 and oriented at a substantially right angle to the first portion 36. These various portions of the landing gear strut 16 allow the gear 16 to be attached to the model 10 in such a manner that the fuselage 20 of the aircraft is displaced from the surface on which the model 10 is resting.

Figure 5A:
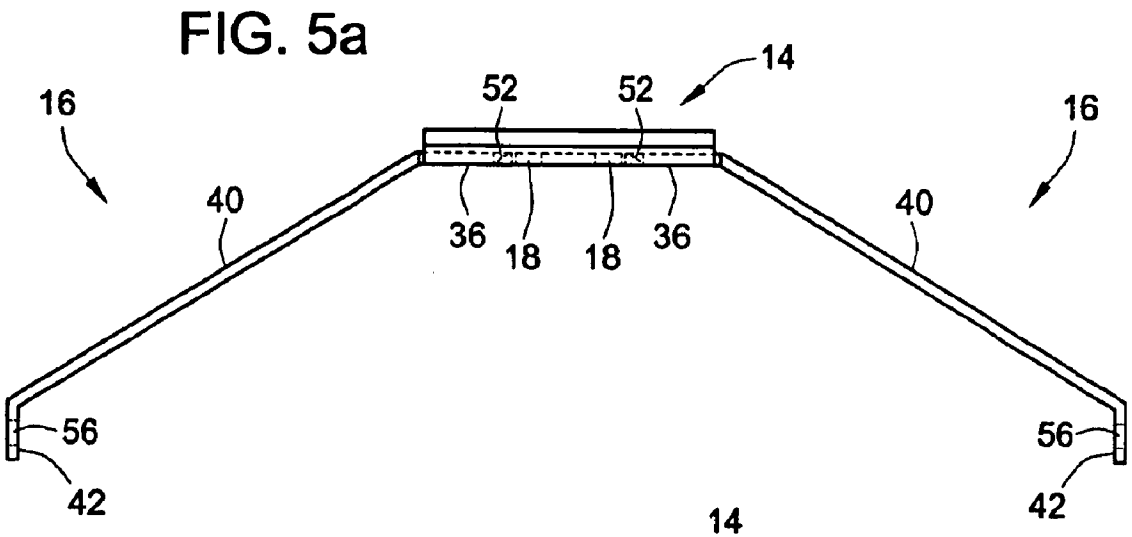
FIG. 5*a* is a front view of the complete landing gear assembly showing both landing gear struts attached to the mounting block.
Figure 5B:
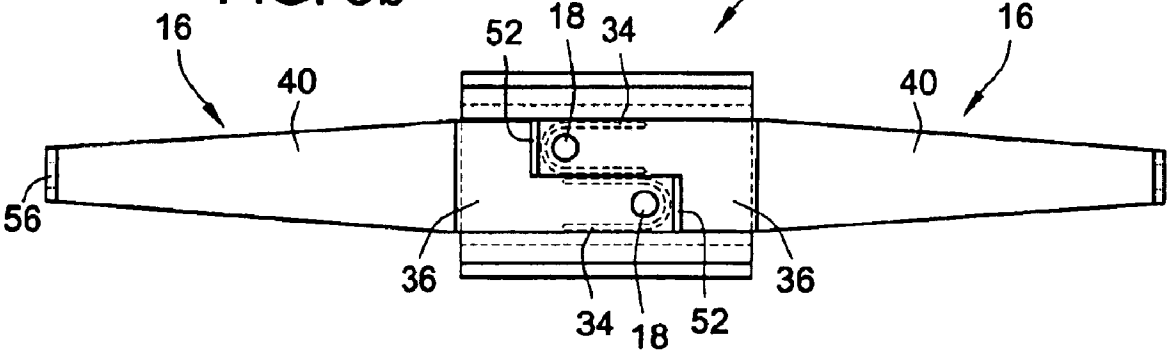
FIG. 5*b* is a top view of the complete landing gear assembly.
Figure 5C:
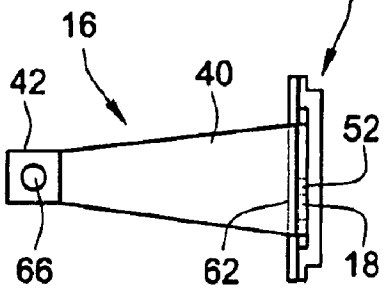
FIG. 5*c* is an end view of the complete landing gear assembly.

The two landing gear struts 16 that comprise the pair of gear struts are identical. This allows the first portion 36 of each of the landing gear struts 16 to be married up to one another when they are positioned in the mounting block 14, as shown in FIG. 5(*b*).

Figure 6:
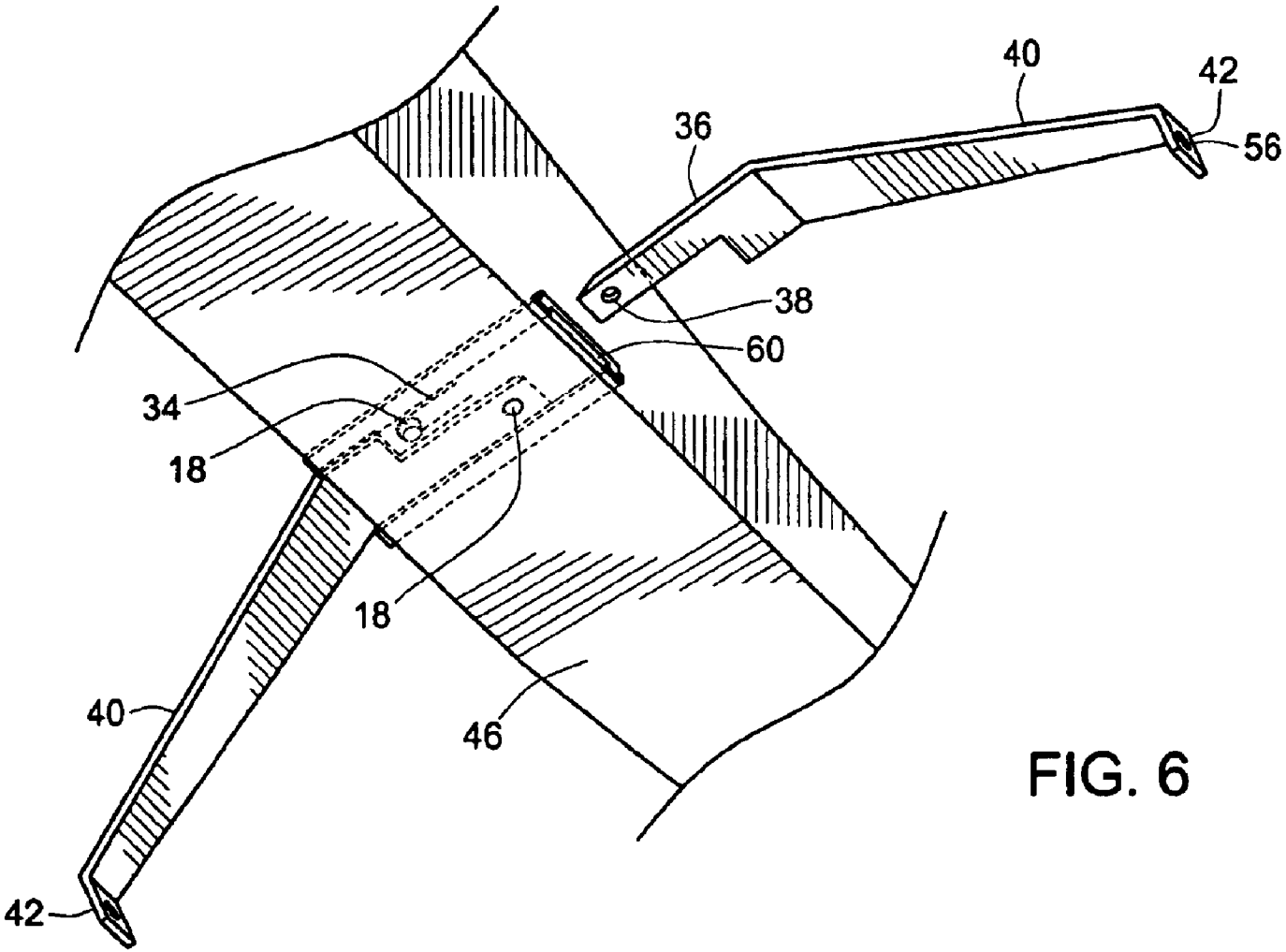
FIG. 6 is a perspective view of the underside of a portion of the fuselage showing the mounting block positioned within the fuselage.

When in use, the mounting block 14 is positioned within a fuselage 20 of a model aircraft 10, as shown in FIGS. 1, 2 and 6. The mounting block 14 can be mounted in the fuselage using any number of ways known in the art including, gluing the mounting block 14 onto plywood plates and hardwood blocks which are then glued to the fuselage. The fuselage 20 includes a top 44 and a bottom 46 along with opposing sides 48, 50. The opposing sides 48, 50 of the fuselage 20 each define an opening 60 and the mounting block 14 is positioned such that the first side 24 of the planar surface 22 is oriented toward the top 44 of the fuselage 20, and the bottom side 26 faces the bottom 46 of the fuselage 20.

Figure 7:
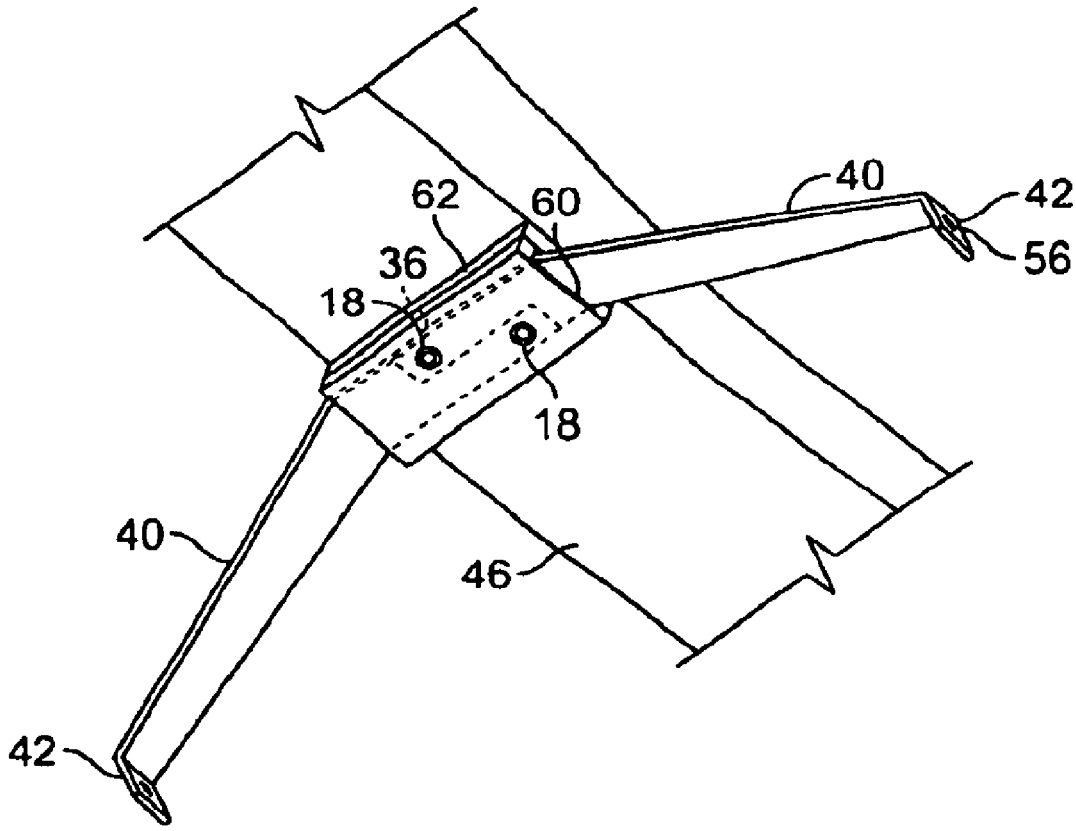
FIG. 7 is a perspective view of the underside of a portion of the fuselage showing the mounting block attached to an intermediate mounting block on the underside of the fuselage.

In an embodiment, the mounting block 14 may be attached to an intermediate-mounting surface 62 such as a piece of balsa wood. This intermediate-mounting surface is then affixed to the fuselage 20. The mounting block 14 with the intermediate-mounting surface 62 attached may also be positioned on the outer surface of the bottom 46 of the fuselage 20, as shown in FIG. 7, without departing from the scope of the invention.

In order to attach the landing gear struts 16, the first portion 36 of one of the pair of landing gear struts 16 is passed through the opening 60 in one side 48 of the fuselage 20, as shown in FIG. 6, and the first portion 36 of the second of the pair of landing gear struts 16 is passed through the opening 60 in the opposing side 50 of the fuselage 20, whereby the hole 38 in the first portion 36 of each of the pair of landing gear struts 16 engages an individual attachment point 18.

The engagement of the landing gear strut 16 to the mounting block 14 is facilitated by the force of the inclined first edge 52 of the first portion 36 of the gear strut 16 passing over the planar surface 22 of the mounting block 14 causing the attachment point 18 to slide up the incline 52 and recess into the planar surface 22. This is accomplished in that the slit 34 creates a spring effect in the surface 22 of the mounting block 14 in the vicinity of the attachment point 18. This spring allows the attachment point 18 to recess toward the top of the mounting block 14 as the first portion 36 of the landing gear strut 16 passes over planar surface 22. As the attachment point 18 is recessed, the hole 38 in the first portion 36 of the landing gear strut 16 passes beneath the attachment point 18 which then "snaps" into the hole 38. This causes the attachment point 18 to spring back thereby securing the landing gear strut 16 to the mounting block 14.

As can be seen in FIGS. 4(*a*) and 4(*b*), in an embodiment, the two landing gear struts are identical to and compliment one another in that the first portion 36 of each of the pair of landing gear struts 16 has a first end 52 and a second end 54. The first end 52 has a first width and the second end 54 has a second width that is greater than the first width. This difference in width allows the two landing gear struts 16 to be married up to one another when they are placed directly next to each other in the channel 28 formed in the mounting block 14, as shown in FIG. 5(*b*). In a particular version of this embodiment, the width of the first end 52 of the first portion 36 is one-half the width of the second end 54.

In an embodiment, first portions 36 of each of the landing gear struts 16 fit completely in the channel 22 formed in the mounting block 14. Because the channel 22 has a width equal to the width of the second end 54 of the first portion 36 and twice the width of the first end 52, the first portion 36 of each of the landing gear struts 16 fits snuggly into the channel 22. This snug fit, along with the attachment points 18, allows the landing gear struts 16 to be retained in the mounting block 14 of the landing gear assembly 12.

In an embodiment, the third portion 42 of the landing gear struts 16 can be fitted with a wheel, tire, pontoon or ski as necessary to complete the model 10 and facilitate use on a particular surface. To provide for this, a hole 56 is provided on the third portion 42 of the landing gear strut 16, as shown in FIG. 5(*c*). As shown in FIG. 5(*a*), the second portion 40 of the landing gear strut 16 may be angled anywhere between 0°–90° from the first portion 36 with an approximately 45° angle being used in a particular embodiment. Of course, the mounting block 14 may be positioned in the fuselage 20 with the second 26 side of the planar surface 22 oriented toward the top 44 without departing from the scope of the invention.

The mounting block 14 and landing gear struts 16 may be manufactured of any suitable material including, but not limited to, metal, plastic or nylon. The material should, however, be capable of flexing to absorb the shock that is transmitted through the landing gear strut 16 as a result of the landing or taxiing of the model aircraft 10.

All references, including publications, patent applications, and patents cited herein, are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A model aircraft having a landing gear assembly comprised of:

a pair of landing gear struts attached to a mounting block, the mounting block including individual attachment points for each landing gear strut comprising the pair of landing gear struts, and a planar surface having a first side and a second side, the second side of the planar surface defining a channel with respect to a first and a second edge of the mounting block;

a pair of slits defined in a bottom surface of the channel; and at least one of the pair of slits surrounds a portion of an individual attachment point.

2. The model aircraft of claim 1, wherein each of the landing gear struts includes:

a first portion defining a hole and having an inclined first edge, the first portion oriented substantially parallel to the planar surface of the mounting block;

a second portion adjacent to and angled less than 90° with respect to the first portion; and a third portion adjacent to the second portion and oriented at a substantially right angle to the first portion.

3. The model aircraft of claim 2, wherein:

the mounting block is positioned within a fuselage of a model airplane, the fuselage having a top and a bottom and opposing sides, the opposing sides each defining an opening, and the mounting block positioned such that the first side of the planar surface is oriented toward the top of the fuselage;

the first portion of one of the pair of landing gear struts passes through the opening in one side of the fuselage; and the first portion of the second of the pair of landing gear struts passes through the opening in the opposing side of the fuselage, whereby the hole in the first portion of each of the pair of landing gear struts engages an individual attachment point.

4. The model aircraft of claim 3, wherein the second side of the planar surface is oriented toward the top of the fuselage.

5. The model aircraft of claim 2, wherein:

the first portion of each of the pair of the landing gear struts has a second end;

the first end has a first width;

the second end has a second width;

and the second width is greater than the first width.

6. The model aircraft of claim 5, wherein the channel has a width equal to twice the first width of the first end.

7. The model aircraft of claim 2, wherein a wheel is attached to the third portion.

8. The model aircraft of claim 2, wherein the second portion is angled approximately 45° with respect to the first portion.

9. A landing gear assembly comprised of:

a pair of landing gear struts attached to a mounting block, the mounting block including individual attachment points for each landing gear strut comprising the pair of landing gear struts, and a planar surface having a first side and a second side, the second side of the planar surface defining a channel with respect to a first and a second edge of the mounting block;

a pair of slits defined in a bottom surface of the channel; and at least one of the pair of slits surrounds a portion of an individual attachment point.

10. The landing gear assembly of claim 9, wherein each of the landing gear struts includes:

a first portion defining a hole and having an inclined first edge, the first portion oriented substantially parallel to the planar surface of the mounting block;

a second portion adjacent to and angled less than 90° with respect to the first portion; and a third portion adjacent to the second portion and oriented at a substantially right angle to the first portion.

11. The landing gear assembly of claim 10, wherein:

the mounting block is positioned within a fuselage of a model airplane, the fuselage having a top and a bottom and opposing sides, the opposing sides each defining an opening, and the mounting block positioned such that the first side of the planar surface is oriented toward the top of the fuselage;

the first portion of one of the pair of landing gear struts passes through the opening in one side of the fuselage; and the first portion of the second of the pair of landing gear struts passes through the opening in the opposing side of the fuselage, whereby the hole in the first portion of each of the pair of landing gear struts engages an individual attachment point.

12. The landing gear assembly of claim 11, wherein the second side of the planar surface is oriented toward the top of the fuselage.

13. The landing gear assembly of claim 10, wherein:

the first portion of each of the pair of the landing gear struts has a second end;

the first end has a first width;

the second end has a second width;

and the second width is greater than the first width.

14. The landing gear assembly of claim 13, wherein the channel has a width equal to twice the first width of the first end.

15. The landing gear assembly of claim 10, wherein a wheel is attached to the third portion.

16. The landing gear assembly of claim 10, wherein the second portion is angled approximately 45° with respect to the first portion.

17. A model aircraft having a landing gear assembly comprised of:

at least one landing gear strut attached to a mounting blocks the mounting block including individual attachment points for the at least one landing gear strut, and a planar surface having a first side and a second side, the second side of the planar surface defining a channel with respect to a first and a second edge of the mounting block;

a pair of slits defined in a bottom surface of the channel; and at least one of the pair of slits surrounds a portion of an individual attachment point.

* * * * *